US006860194B2

(12) United States Patent
Pope

(10) Patent No.: US 6,860,194 B2
(45) Date of Patent: Mar. 1, 2005

(54) PACKAGE FOR HEATING A FOOD PRODUCT

(75) Inventor: Simon Pope, North Yorkshire (GB)

(73) Assignee: McCain Foods Limited (CA)

( * ) Notice: Subject to any disclaimer, the term of this patent is extended or adjusted under 35 U.S.C. 154(b) by 109 days.

(21) Appl. No.: 10/149,128

(22) PCT Filed: Apr. 20, 2001

(86) PCT No.: PCT/GB01/01798

§ 371 (c)(1),
(2), (4) Date: Jun. 5, 2002

(87) PCT Pub. No.: WO01/81200

PCT Pub. Date: Nov. 1, 2001

(65) Prior Publication Data

US 2002/0179697 A1 Dec. 5, 2002

(30) Foreign Application Priority Data

Apr. 20, 2000 (GB) ..... 0009881
Nov. 29, 2000 (GB) ..... 0029104

(51) Int. Cl.[7] ..... A47J 37/08; H05B 6/80

(52) U.S. Cl. ..... 99/401; 99/447; 99/449; 220/912; 220/913; 219/735

(58) Field of Search ..... 99/401, 426, 447, 99/449, DIG. 14; 126/273.5, 275 R; 219/730, 734, 735; 220/913, 912, 573.1; 426/107, 113, 122; 229/903, 120

(56) References Cited

U.S. PATENT DOCUMENTS

| | | | | |
|---|---|---|---|---|
| 4,096,948 A | | 6/1978 | Kuchenbecker | |
| 4,406,218 A | * | 9/1983 | Hatakeyama | 99/401 |
| 4,592,914 A | * | 6/1986 | Kuchenbecker | 426/107 |
| 4,785,160 A | * | 11/1988 | Hart | 219/730 |
| 5,326,022 A | | 7/1994 | Green | |
| 5,365,833 A | * | 11/1994 | Chen | 99/447 |
| 5,565,228 A | * | 10/1996 | Gics | 426/107 |

FOREIGN PATENT DOCUMENTS

| | | |
|---|---|---|
| EP | 0 336 325 A2 | 10/1989 |
| EP | 0 824 481 B1 | 2/1998 |
| FR | 2 658 797 A1 | 8/1991 |
| FR | 2 782 069 A1 | 2/2000 |
| WO | WO-99/04638 A2 | 2/1999 |

* cited by examiner

*Primary Examiner*—Reginald L. Alexander
(74) *Attorney, Agent, or Firm*—Lerner, David, Littenberg, Krumholz & Mentlik, LLP

(57) ABSTRACT

An ovenable enclosure (10) for pizza or other heatable food product comprises a box of taint free board having an interior clearance over the pizza, a central vent (15) in the upper surface and a metal plate (16) on lower surface. The enclosure gives more consistent heating of the pizza with reduced edge dryness.

7 Claims, 2 Drawing Sheets

PACKAGE FOR HEATING A FOOD PRODUCT

Figure 1:
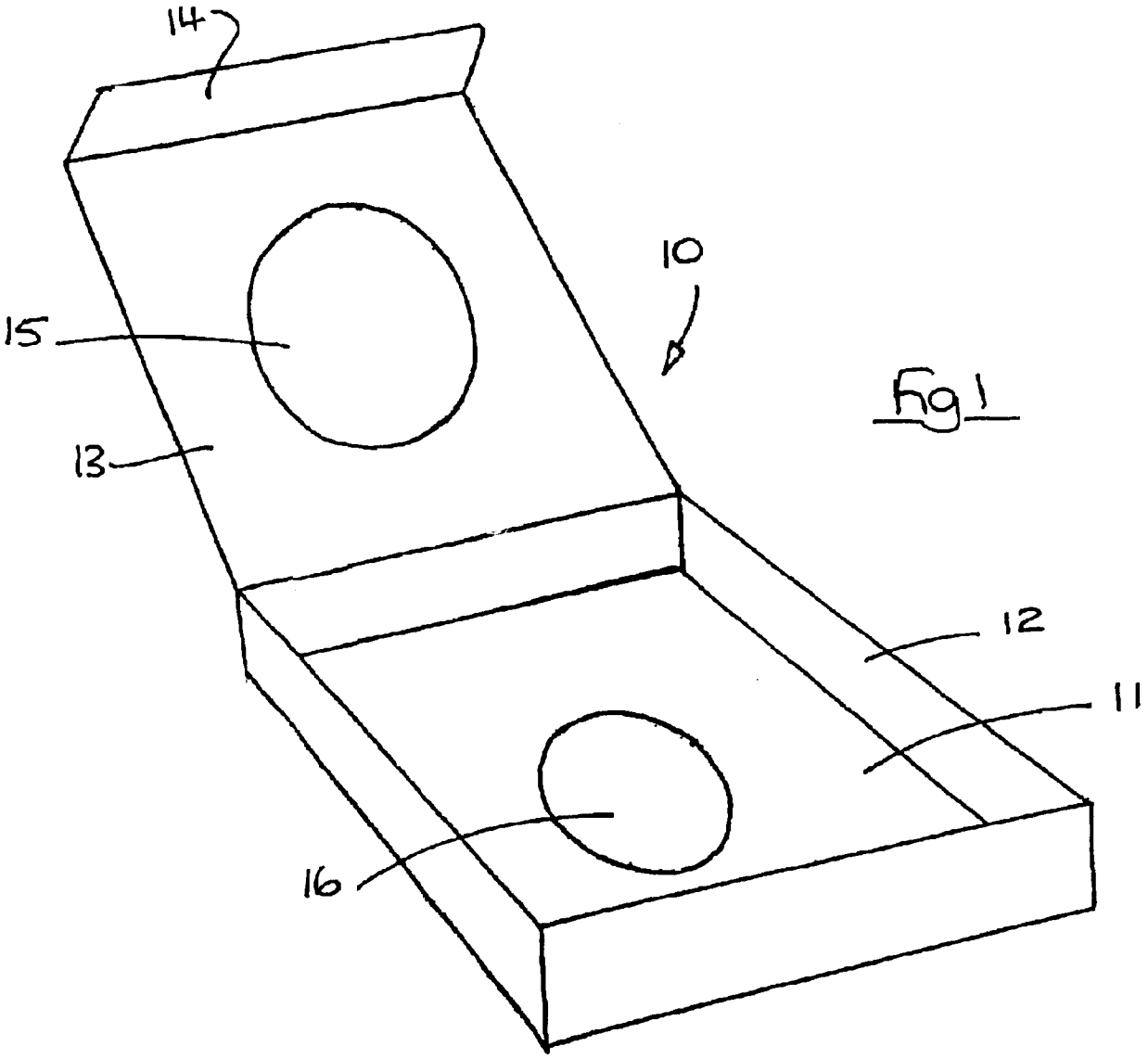

This invention relates to an ovenable enclosure for heating/cooking and particularly to a box for pizza, preferably a box suitable for frozen pizza.

Many different kinds of such heating enclosures are known, some of which comprise the original packaging in which a frozen food product is sold. In the latter case, the kind of packaging will depend on the heating/cooking medium to be used. For example different kinds of packaging are often required for oven heated and microwave heated products. The former must be adapted to resist considerable external heat radiation yet allow the food product to be heated, whereas the latter is heated indirectly by material within the packaging.

Food products intended to be heated by microwave may require some additional radiated heat in order to give a fully cooked and 'browned' appearance. For that reason heating enclosures are known which include a metallic coating adapted to give enhanced heating in selected areas of the enclosure. One such microwave enclosure is known from EP-A-0336325. A microwave oven may include a radiant element to ensure browning.

These types of heating enclosures have the advantage that the contents need not be handled prior to serving the hot food product as a meal. The use of packaging as a cooking enclosure for microwaveable frozen food has had an important effect on the quality and consistency of the resulting hot food product. This is because the cooking timer of a microwave oven tends to be very accurate and because the energy source ceases at the end of the cooking time. Thus the cooking environment can be closely controlled by the packaging to give an optimum result.

Oven heated food products are more problematic because there are many variables which cannot be controlled, and because users have many more options available. For example despite written instructions, a user may not wait for an oven to reach a required temperature, the oven may have an uneven heat distribution, oven temperature control is often rather poor, and cooking time is difficult to control accurately particularly because residual heat will continue to cook the product even if the energy source is turned off.

A particular problem arises due to the large thermal mass of oven heated frozen pizza where dryness of the pizza crust and/or burning of the topping can be difficult to avoid. What is required is a heating enclosure capable of more closely controlling the cooking environment in an oven so as to reduce the variability in the quality of the hot food product, and preferably an enclosure that is adapted to resist up to 300° C. for up to one hour.

According to the present invention there is provided an enclosure for pizza, the enclosure being of ovenable material and adapted for exposure to a source of heating energy, wherein the enclosure includes a lower surface adapted to support a pizza and an upper surface adapted to cover the pizza, the upper surface having an openable vent in a mid region thereof whereby the interior of the enclosure can be vented during heating thereof. The pizza may be frozen or chilled, and may be part cooked.

Such an enclosure permits the heating/cooking environment within the enclosure to be closely controlled, and to better ensure that the heated/cooked food product is to the required standard. Naturally, the material of the enclosure should be capable of exposure to heating energy without imparting any flavour or odour taint to pizza in the enclosure.

In one embodiment, the upper surface of the enclosure comprises an inner layer having a pre-formed vent or vents therein, and an outer layer which hermetically seals the enclosure for sale and transit, and which is removable just before heating/cooking. The outer layer may, for example, be a film of any conventional and suitable kind.

The vent or vents may alternatively be part sheared through the packaging or otherwise defined by lines of weakness whereby the hermetical seal is broken as the vent or vents are opened.

A typical pizza is approximately circular and contained in an enclosure which is square in plan and close fitting. In a preferred embodiment a single vent is centred on the pizza and is preferably circular. The vent area is preferably in the range 5–80% of the upper surface area of the enclosure, most preferably in the range 20–60%.

In another embodiment the vent area is in the range 10–70% of the area of the pizza, most preferably in the range 20–60%. In the case of a single circular vent the diameter ratio may be in the range 1:6 to 1:2 and alternatively in the range 1:4 to 1:3. Such an arrangement gives a favourable heating/cooking environment.

A plurality of vents may be provided and comprise 40–80% of the surface area of approximately the central 50% of the lid, and from 5–25% of the remainder.

A vent in the upper surface of the enclosure is also useful since it permits the user to see the pizza before cooking, and to inspect the pizza during cooking. This has been found to be an important advantage since users tend to want to see the unheated food product and accordingly will open the enclosure even if instructions require the enclosure to remain closed. Accordingly the invention also provides a solution to this inevitable urge, thus permitting the enclosure to perform the intended purpose of better controlling the heating/cooking environment.

The enclosure of the invention is preferably close fitting to the pizza, and in particular the inside of the upper surface is spaced from the pizza by a relatively small distance. Preferably the interior height of the enclosure is not more than about 150% of the thickness of the pizza, and is most preferably in the range 100–150%. In a preferred embodiment the interior height of the enclosure is about equal to 120% of the thickness of the pizza.

One enclosure according to the invention comprises a close fitting square box for a round frozen pizza, typically of about 225 mm in diameter. The pizza sits on the base of the box and is spaced from the inside top surface by a distance of around 5–10 mm. The upper surface of the box contains a central circular vent of about half the width of the pizza, and in the range 90–135 mm. In a preferred embodiment, a vent of 120 mm in diameter is provided.

A pizza cooked in an oven in such an enclosure avoids the dry edge characteristic of cooking on a simple plate-like base. Moisture loss is typically reduced from around 10% to 3%, the retained moisture maintaining a soft pizza edge. The vent allows even browning of the top of the pizza and improves the overall texture of the pizza, whilst avoiding the characteristic pale appearance of a pizza cooked in a closed environment.

Venting may be provided in the sides of a box-like enclosure typically from 5–25% of the side surface area. Such venting may be provided in any of the ways mentioned above.

The lower surface of the enclosure may define a tray for the pizza and have upstanding sides to confine the pizza therein. One or more sides may be adapted to collapse in order to permit the cooked pizza to slide from the enclosure onto a plate.

The pizza preferably rests on a metal plate, typically a centrally placed circular metal disc having a surface area in the range 5–80% of the area of the lower surface of the enclosure. The metal may be of any suitable composition, for example aluminium, copper or steel having a suitable protective coating to avoid e.g. odour taint. The metal plate may comprise a foil sheet of 50 micron thickness, or be relatively smaller in area and have a greater thickness.

The purpose of the metal plate is to provide a highly conductive heat source adapted to promote heat transfer to the centre of the pizza, thereby to improve the taste, texture, smell and flavour of the hot food product.

The preferred size and thickness of the metal plate is selected empirically to suit the degree of additional heat transfer which is required, and will depend to some extent on the mass of the plate, and the nature of the pizza topping.

In a preferred embodiment an aluminium foil disc of 50 micron thickness and in the diameter range 60–90 mm is provided for a pizza of 225 mm in diameter. In conjunction with the vent or vents, the source of direct thermal energy gives a particularly effective and adaptable heating/cooking enclosure, in which cooking conditions can be optimised to suit a pizza of known characteristics.

In a particularly preferred embodiment a foil disc of 75 mm is effective in improving temperature distribution through the cooked pizza, giving a more even temperature, and a slightly reduced overall temperature.

The metal plate is preferably substantially smaller than the pizza, and typically has a diameter in the range 25–40% of the diameter of the pizza. Such an arrangement avoids an over moist pizza base typical of a foil tray for the pizza, and avoids excessive heat transfer away from the pizza after removal from the oven.

Such foil disc is preferably used in an enclosure having a vent area greater than or equal to the area of the disc. In a preferred embodiment the diameter of the disc is about 75% of the diameter of a circular vent.

The enclosure may further include an embossed support surface for the pizza. Such a surface permits better crisping of the pizza base by assisting moisture removal.

An aperture or apertures may be provided in the pizza support surface to further provide moisture removal in selected areas and crisping of the base.

The upper surface preferably comprises a lid having depending sides which may abut or overlap the lower surface. In the preferred embodiment the enclosure is rectangular, and the lid is hinged to the tray along one edge thereof Preferably the upstanding and/or depending sides are collapsible so that the pizza can be easily portioned and removed for eating.

The enclosure may have an outer layer which both hermetically seals the contents thereof, and carries printed product information and the like. In this way, printing of the enclosure itself is avoided, and thus the inner packaging can be optimised as a cooking enclosure without reference to external appearance and/or consumer perception.

Figure 2:
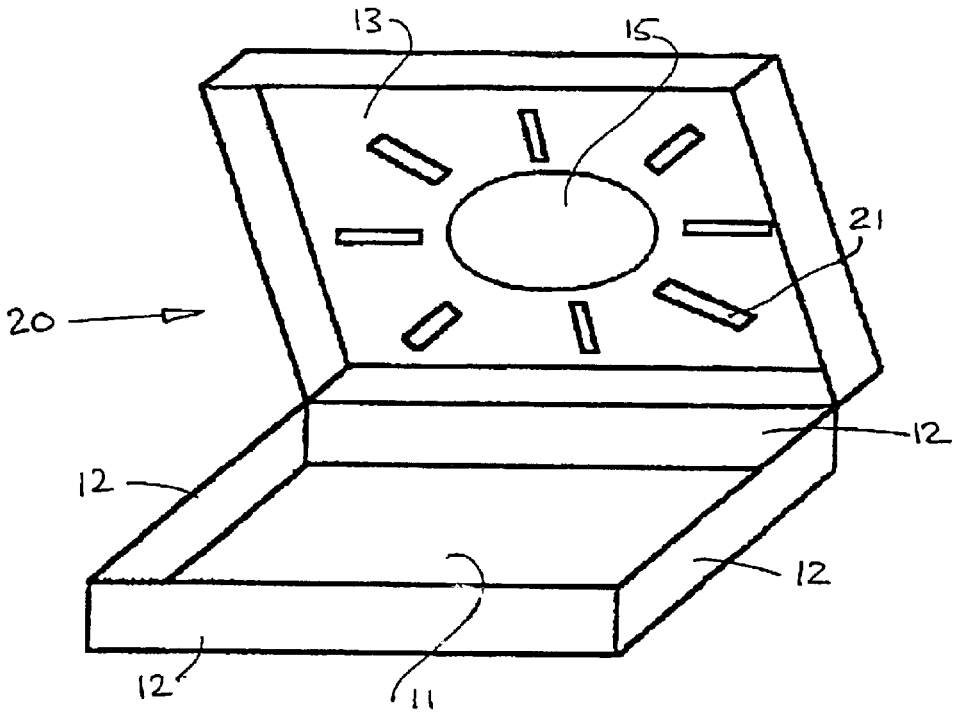

Other features of the invention will be apparent from the following description of preferred embodiments shown by way of example only in the accompanying drawings in which:

FIG. 1 illustrates a first cooking enclosure according to the invention, and FIG. 2 illustrates a second cooking enclosure according to the invention.

With reference to the FIG. 1, a square flip-top box 10 of a heat resistant taint free board comprises a tray 11 with upstanding sides 12, and a lid 13 with a tuck in flap 14. The box 10 is shallow and adapted to contain a frozen pizza. The lid 13 is hinged to the tray 11 along one edge. A suitable material for the box is for example extruded PET coated paper board of an appropriate grade.

Within the lid 13 is a central circular aperture 15. In the base of the tray is a circular aluminium foil disc 16. The aperture 15 has a diameter about 40% of the width of the box 10 and the disc has a diameter about 30% of the width of the box 10.

In use the circular frozen pizza is placed on the tray 11, the lid 13 is closed, and an outer layer of e.g. plastic film is applied to hermetically seal the contents. The outer layer may be for example a clear plastic sleeve, heat sealed along opposite edges and carrying printed product information. The box may include one or more glued flaps in order to further preserve the integrity thereof during transit.

After sale, and immediately before heating/cooking, the outer layer is removed to expose the vent 15, and the box is inserted unopened into an oven. The pizza is heated/cooked according to pre-printed instructions and when ready is removed from the oven for consumption. As illustrated the box is hinged open, and the sides 12 of the tray 11 may be collapsed to permit ready serving. These sides 12 may, for example, have lines of weakness at the corners.

The size, number and pattern of vents may be changed to give a required heating/cooking characteristic. An alternative enclosure 20 is illustrated in FIG. 2 and has additional radial vents 21, other common features having the same reference numerals.

The inside of the trays 10, 20 may include a metal or metallised layer of foil or other material adapted for direct heating by a source of heating energy.

The tray may further include an oil resistant coating or film whereby oil may be added to enhance the heating/cooking process in order to give a desirable mouth feel and texture to the pizza.

Although a circular vent and circular metal plate have been described, such shapes are not essential. Other shapes of vent having an attractive or eye-catching appearance are possible whilst ensuring good product appearance after heating. Other shapes of metal plate are also possible, and a rectangular or square plate may be preferred to avoid excessive wastage of material during blanking. The metal plate is preferably secured to the base of the enclosure by a food compatible adhesive.

The vent and plate may be constituted by a plurality of discrete elements such as an array of holes and metal spots adapted to give the desired appearance to the hot food product.

What is claimed is:

1. An ovenable frozen pizza enclosure adapted for exposure to a source of heat, comprising:

a lower surface adapted to support a pizza and an upper surface adapted to cover a pizza, the lower and upper surfaces being formed from a heat resistant taint free board;

the upper surface having a circular openable vent in a mid region thereof, whereby the interior of the enclosure can be vented dufing heating thereof, the vent having an open area in the range of 20–60% of an area of the upper surface, and the lower surface having a metal foil plate on the inside thereof, the plate having an area less than or equal to the area of the vent.

2. An enclosure according to claim 1, wherein the upper surface of the enclosure comprises an inner layer having a pre-formed vent therein, and an outer layer adapted to hermetically close the vent and which is removable just before heating/cooking.

3. An enclosure according to claim 1, wherein the vent is defined by lines of weakness in the upper surface, whereby a hermetical seal is broken as the vent is opened in use.

4. An enclosure according to any of claims 1, 2 or 3, wherein the plate is circular.

5. An enclosure according to any of claims 1, 2 or 3, wherein the plate is circular and co-axial with the vent.

6. An enclosure according to any of claims 1, 2 or 3, wherein the enclosure has an interior height less than 150% of the thickness of a pizza intended therefor.

7. An enclosure according to any of claims 1, 2 or 3, wherein the lower surface is internally embossed.

* * * * *

UNITED STATES PATENT AND TRADEMARK OFFICE

CERTIFICATE OF CORRECTION

PATENT NO. : 6,860,194 B2
DATED : March 1, 2005
INVENTOR(S) : Simon Pope

It is certified that error appears in the above-identified patent and that said Letters Patent is hereby corrected as shown below:

Column 5,
Line 3, "hermetical" should read -- hermetic --.

Signed and Sealed this

Twenty-fourth Day of May, 2005

JON W. DUDAS
*Director of the United States Patent and Trademark Office*